United States Patent [19]

Ono et al.

[11] 3,993,971

[45] Nov. 23, 1976

[54] ELECTROMAGNETIC RELAY

[75] Inventors: Kenji Ono, Neyagawa; Hiromi Nishimura, Takaishi; Tetsuo Mori, Hirakata, all of Japan; Hans Sauer, Deisenhofen, Germany

[73] Assignees: Matsushita Electric Works, Ltd., Osaka, Japan; Hans Sauer, Deisenhofen, Germany; part interest to each

[22] Filed: May 14, 1975

[21] Appl. No.: 577,181

[30] Foreign Application Priority Data

| | | |
|---|---|---|
| May 15, 1974 | Japan | 49-54368 |
| July 31, 1974 | Japan | 49-88342 |
| Sept. 13, 1974 | Japan | 49-106400 |
| Sept. 30, 1974 | Japan | 49-113025 |
| Oct. 2, 1974 | Japan | 49-114164 |
| Nov. 20, 1974 | Germany | 2454967 |

[52] U.S. Cl. ..... 335/202; 335/78; 335/125; 335/203

[51] Int. Cl.[2] ..... H01H 50/04

[58] Field of Search ..... 335/78, 79, 80, 81, 335/83, 86, 125, 128, 133, 187, 202, 132, 203

[56] References Cited

UNITED STATES PATENTS

| | | | |
|---|---|---|---|
| 3,211,858 | 10/1965 | Juptner | 335/80 |
| 3,634,793 | 1/1972 | Sauer | 335/78 |
| 3,717,829 | 2/1973 | Flaherty | 335/202 |
| 3,748,607 | 7/1973 | Mori | 335/125 |
| 3,906,416 | 9/1975 | Sprando | 335/80 |

*Primary Examiner*—Harold Broome
*Attorney, Agent, or Firm*—Wigman & Cohen

[57] ABSTRACT

An electromagnetic relay is disclosed comprising within its coil bobbin a magnetic core, the ends of which extend substantially at right angles to the longitudinal axis of the bobbin so as to form pole shoes projecting from the coil bobbin and having mutually aligned pole faces and further comprising an armature which is disposed externally of the coil bobbin between the pole shoes of the magnet core and which is pivotally mounted for rotation about one of its centroid axes, said one axis extending perpendicularly to the longitudinal axis of the bobbin. Contact terminals are disposed on both sides of the longitudinal axis of the coil and are positively located by embedment in a contact carrier, the coil bobbin and the contact carrier extending substantially over the entire length of the coil bobbin and being provided with engaging means for the mutual positioning and retaining of the contact carrier and coil bobbin. The contact terminals have associated therewith prelocated contact springs arranged within the relay, the forces exerted by the contact springs interacting through the armature and including bearing means for the armature provided substantially centrally of the coil between the pole shoes.

52 Claims, 31 Drawing Figures

Fig. 2
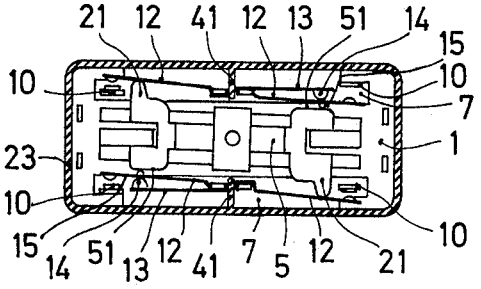
Fig. 3
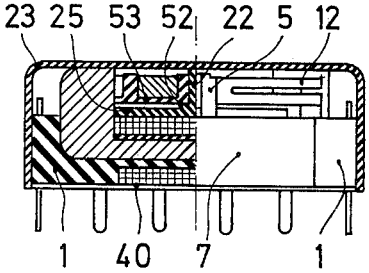
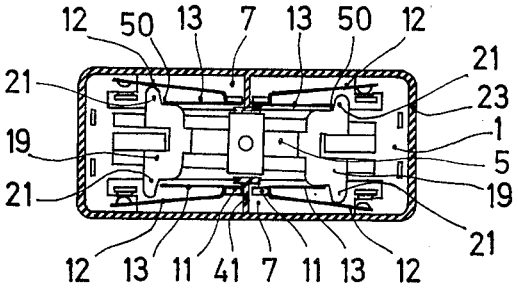
Fig. 4

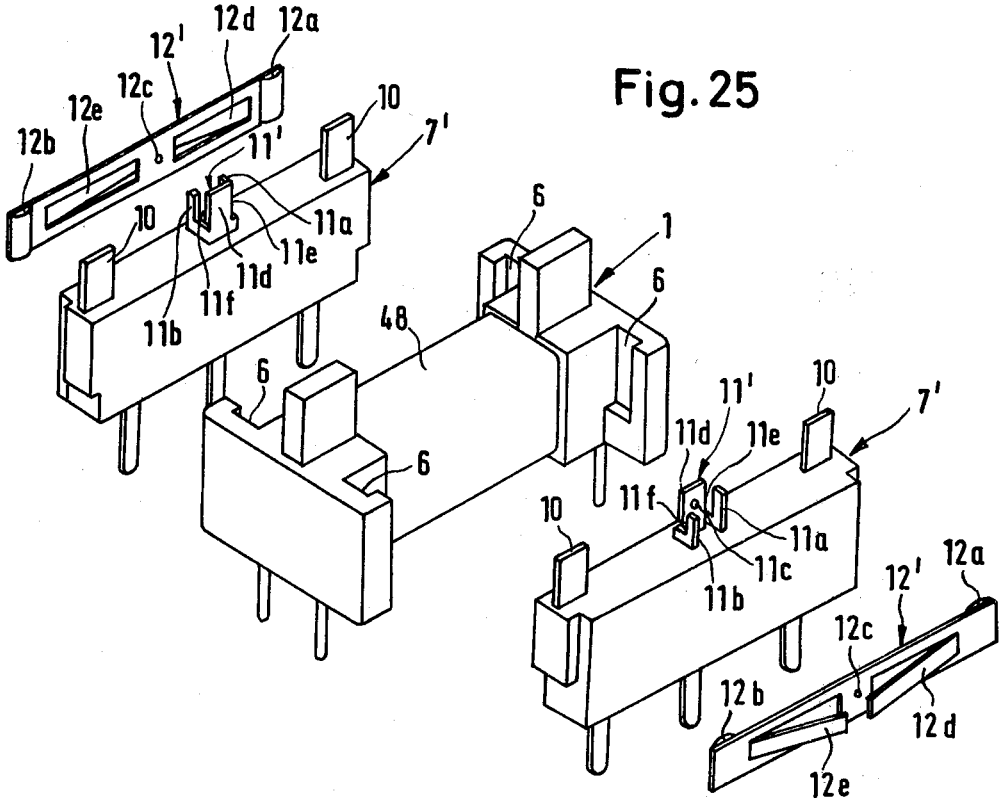
Fig. 25
Fig. 26
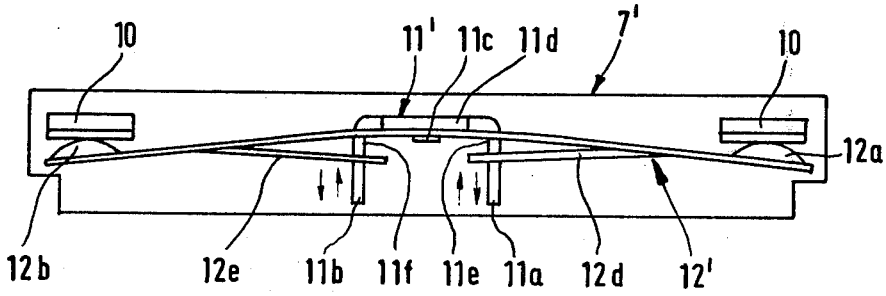

Fig. 29
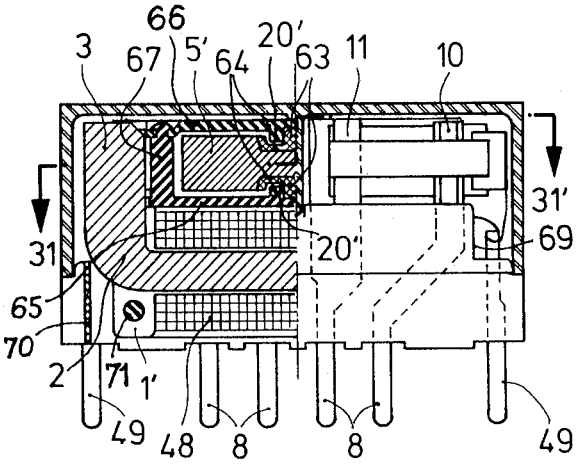
Fig. 30
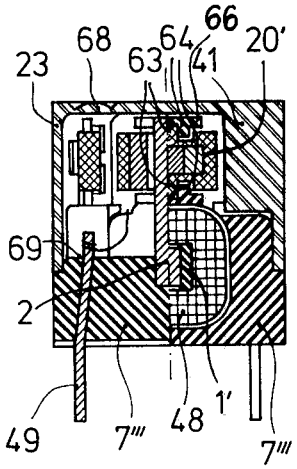
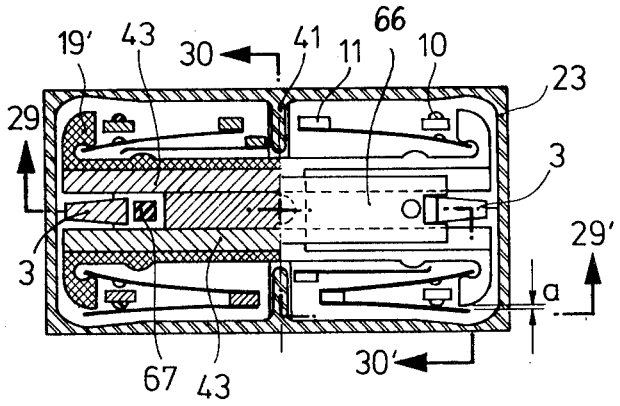
Fig. 31

ELECTROMAGNETIC RELAY

The present invention relates to an electromagnetic relay comprising a magnet core disposed within the coil bobbin, said core having end portions extending substantially at right angles to the longitudinal axis of the bobbin, constituting pole shoes provided with coplanar pole faces projecting from the bobbin, and further comprising an armature arranged externally of said bobbin between the pole shoes of said magnet core and pivotally supported along one of its centroidal axes with said pivotal axis extending perpendicularly to the longitudinal axis of the coil.

A relay of this general construction is described, for example, in the German Patent Specification No. 942,406. In this known relay, the spring rate of the springs serving to retain the armature is matched to the magnet force/travel-characteristic curve which is determined by a quadratic function in order to improve the responsivity of the relay. If the contact forces obtained are left out of consideration, it is possible to reduce the required actuating power to any desired extent by reducing the effective length of said springs, but this measure tends to reduce the contact forces which may be obtained. In other words, where it is desired to obtain larger contact forces, it will be necessary to increase the energizing power correspondingly. However, in such a case it is impossible to employ the force developed by the permanent magnet for the purpose of increasing the contact forces, because a large proportion of the permanent magnet force is absorbed by the springs serving to retain the armature.

It is an object of the invention to provide a relay of the aforeindicated type which is characterized by the fact that it affords a high degree of responsivity, that large contact forces may be obtained, that the arrangement of the contacts may be varied in a simple manner, that the relay is of extremely small size, and that its manufacture on a mass-production basis does not present any problems.

This object is attained, according to the invention, by the provisions set forth in claim 1. A relay of compact construction is thereby obtained in which it is possible in a simple manner to introduce into the coil bobbin from one side thereof the contact carriers provided with their associated contacts, and the armature cooperating with such contacts. The fact that all of the contacts belonging to a given set of contacts are supported by a common contact carrier obviates any necessity of adjusting the contact gaps. Contact springs extending along the armature make it possible, in cases in which a magnetically poled relay is concerned, to store part of the force of the permanent magnet, this feature making it possible to provide a relay which combines a particularly great responsivity with the availability of large contact forces.

Further advantages achieved by the invention and its various developments reside in the fact that the various elements of the relay are combined to a small number of major structural units, i.e., particularly the coil bobbin with winding and magnet core, the contact carrier arrangement with the set of contact springs and contact terminals, the armature with contact actuating members, and these structural units are formed for positive mutual engagement so that they are easy to assemble and are automatically placed in the correct spatial relation with respect to each other. It is a further advantage that the contact forces may be selected and adjusted within wide limits. The pivotal mounting of the armature is designed in such a way that in spite of the relay being easy to assemble, a given small play is maintained for the bearing and that the mobility of the armature is ensured irrespective of the position of the relay even in case outer forces are exerted on the closed relay. The precision of the armature bearing that may be obtained in accordance with the invention results in a particularly high uniformity of the switching characteristics and a long service life. Further preferred embodiments provide a relay which may be hermetically closed on all sides. It is another advantage brought about by the formation of the armature and the arrangement of the contacts in accordance with the invention that a plurality of simultaneously actuable contacts may be provided selectively as normally open or normally closed contacts.

In order that the invention may be more fully understood preferred embodiments will be described in the following with reference to the accompanying drawings, in which:

FIG. 2 is a plan view of a completely assembled relay comprising four normally open contacts;

FIG. 3 is a part-sectional side view of the relay of FIG. 2;

FIG. 4 is a plan view of a completely assembled relay comprising two normally closed and two normally open contacts;

Figure 1:
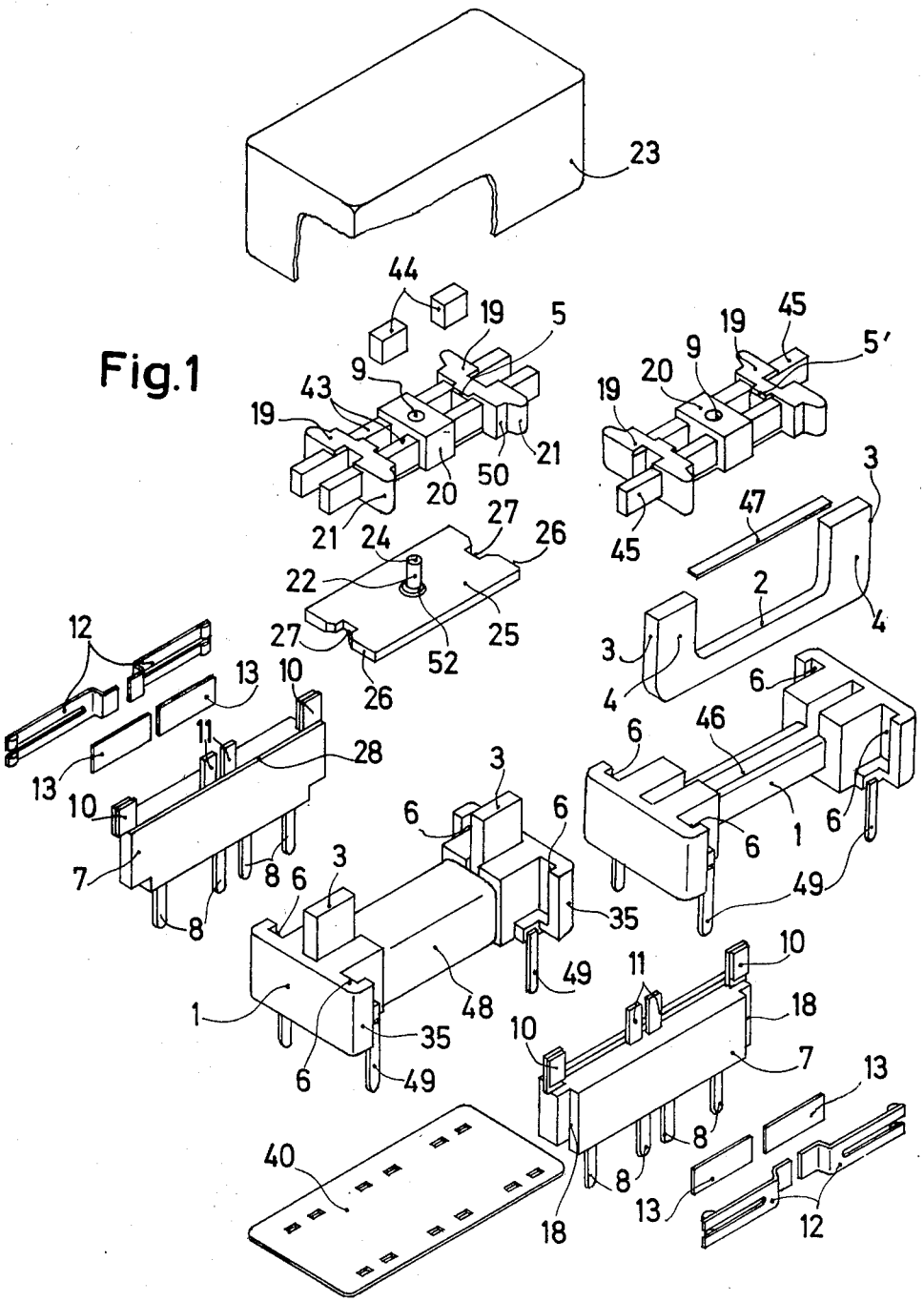
FIG. 1 is an exploded perspective view of an embodiment of a relay.
Figure 8:
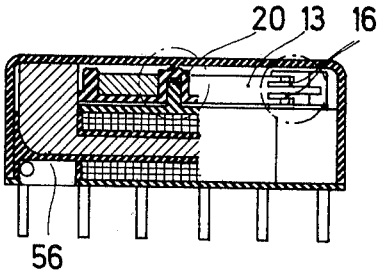
Figure 9:
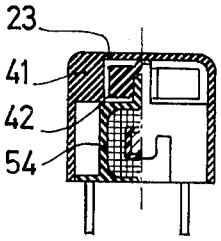
Figure 5:
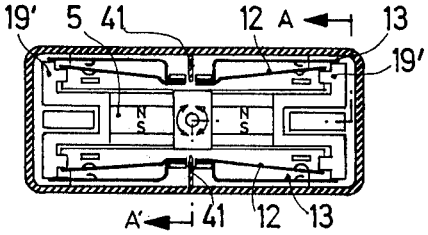
Figure 10:
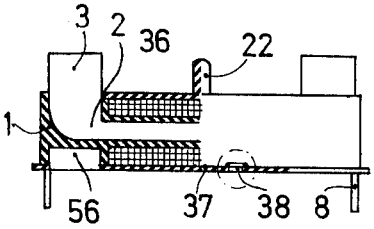
Figure 6:
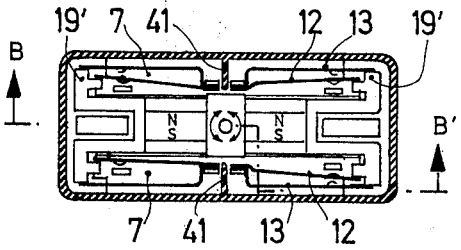
Figure 11:
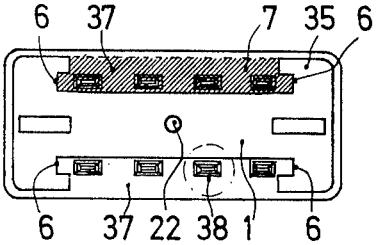
Figure 7:
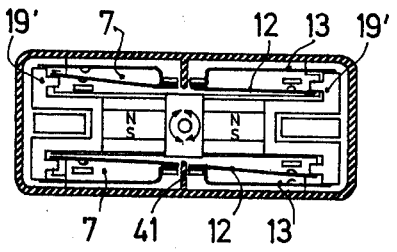
Figure 12:
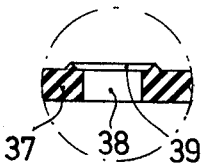
Figure 13:
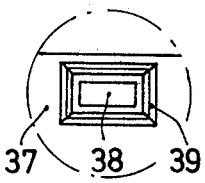
Figure 14:
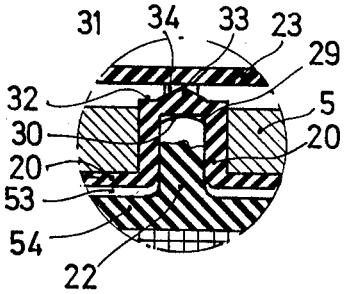
Figure 15:
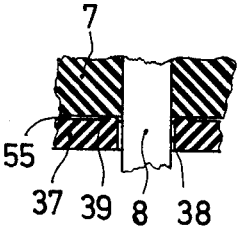
Figure 16:
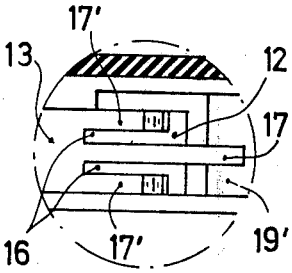
Figure 27:
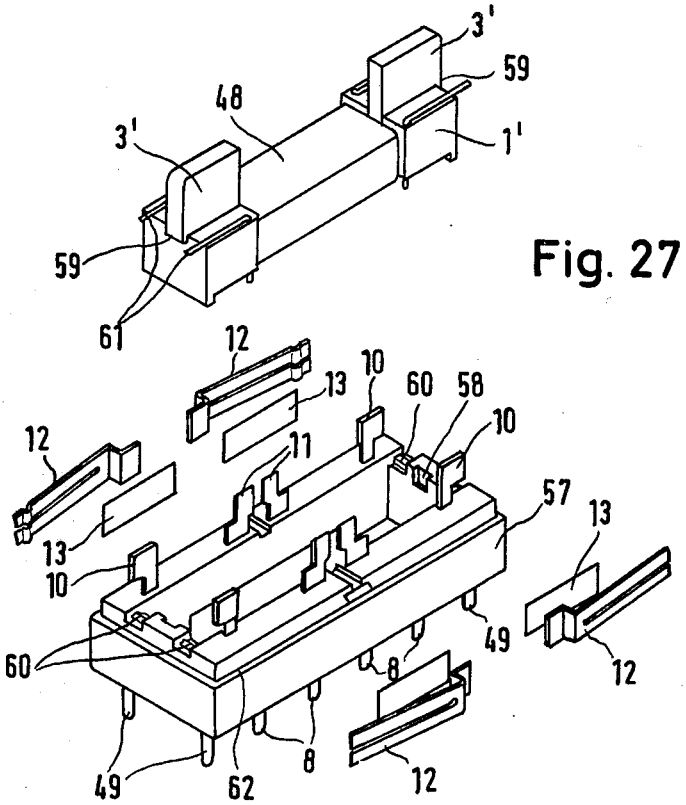
Figure 28:
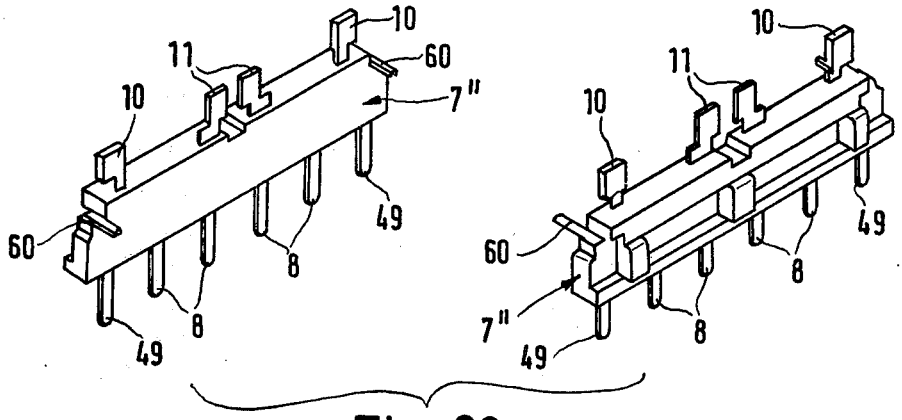

FIGS. 5, 6 and 7 plan views of further completely assembled relays respectively comprising two normally open and two normally closed contacts or three normally open contacts and one normally closed contact or four normally open contacts;

FIG. 8 a part-sectional side view of the relay of FIG. 6;

FIG. 9 a transverse cross-section of the relay of FIG. 5;

FIG. 10 a part-sectional side view of a coil bobbin provided with a magnet core and a coil and enclosed in a jacket of plastic material molded to enclose the assembly formed by the components mentioned;

FIG. 11 a plan view of the coil bobbin of FIG. 10;

FIG. 12 an enlarged representation of the detail enclosed in a circle in FIG. 10;

FIG. 13 an enlarged representation of the detail enclosed in a circle in FIG. 11;

FIG. 14 an enlarged sectional representation of the bearing arrangement of the actuator of the relay of FIG. 8;

FIG. 15 an enlarged fragmentary cross-section illustrating the welded connection between a contact carrier and a baseplate-like bottom portion;

FIG. 16 an enlarged representation of the detail enclosed in a circle in FIG. 8, such detail illustrating one end of an adjusting spring which is provided with longitudinal slots;

FIGS. 17, 18, FIGS. 19, 20, FIGS. 21, 22 and FIGS. 23, 24 respectively illustrate in graphic representations the forces occuring in the polarized relays which are respectively illustrated in FIG. 5, FIG. 7, FIG. 4 and FIG. 2;

FIG. 25 is an exploded view similar to the lower portion of FIG. 1 and showing a further embodiment of the relay according to the invention;

FIG. 26 is a plan view of the contact carrier shown in FIG. 25 with the contact spring mounted;

FIG. 27 is again an exploded view similar to FIG. 1 and showing another embodiment of the relay according to the invention in which the contact carriers are formed as a unitary frame;

FIG. 28 shows the two contact carriers prior to their common encasing to form the contact carrier frame of FIG. 27; and FIGS. 29 to 31 are three sections in mutually vertical planes showing a further embodiment of the electromagnetic relay in accordance with the invention.

The relay shown in FIG. 1 comprises a single-piece coil bobbin 1 which is provided with a groove 46 adapted to receive an essentially U-shaped magnet core 2. Prior to the application of the coil 48 to the bobbin 1, the magnet core 2 inserted in the groove 46 is covered with a small plate 47 of insulating material in order electrically to insulate the magnet core from the coil. The terminal flanges 35 of coil bobbin 1 are provided with recesses 6 for the reception of contact carriers 7 in which contact terminals 8 are fixedly located by being embedded therein. The two contact carriers 7 are insertable into coil bobbin 1 in such a manner as to be symmetrically arranged in relation to the longitudinal axis of the bobbin, and each contact carrier is provided with two separate switching contacts each of which is formed by a contact spring 12 attached to one of two portions 11 of said contact carrier and by one of the contact-material bearing portions 10 of one of the contact terminals embedded in the respective end portion of the contact carrier. With the contact carrier 7 in position in bobbin 1, the contact terminals 8 are aligned with the coil terminals 49, the spacing of the various terminals corresponding to a conventional predetermined pattern. As regards the terminals 8 and 49, such terminals may be arranged in accordance with the well-known dual-in-line system. After the preassembled contact carriers 7 have been inserted into bobbin 1, a bearing plate 25 made of a plastic material and centrally provided with an integrally formed pivot pin 22 for armature 5 is inserted into bobbin 1 and fixedly located at its end faces 26 by the pole shoes 3 of magnet core 2. For the purpose of locating bearing plate 25, this plate is provided at its ends intermediate its longitudinal edges with recesses 27 matching the profile of pole shoes 3. This method of locating pivot pin 22 in relation to pole shoes 3 ensures maximum accuracy as regards the bearing arrangement for armature 5. The length of pivot pin 22 is selected in such a manner that it exceeds by an amount defining a vertical end play of the bearing the depth of a through bearing hole 9 with which armature 5 is provided. The said bearing hole 9 is formed in a plastic formation 20 disposed intermediate the ends of armature 5. Upon the relay being enclosed in its housing can 23, the end face 24 of pivot pin 22 will bear against the inner surface of the upper wall of housing can 23. This arrangement ensures that the mobility of armature 5 will be maintained even in cases in which housing can 23 is subjected to pressure. Bearing plate 25, while serving to support armature 5 for rotation, also serves to locate the two contact carriers 7. To permit this, contact carriers 7 are provided with stepped recesses 28 which are engaged by the under side of bearing plate 25. The armature 5 which is supported for rotation between the two pole shoes 3 on pivot pin 22 is provided with plastic formations 19 and 20 each of which encloses a predetermined part of the armature; in such plastic formations there are provided two elongated ferromagnetic portions 43 of the armature, such portions being disposed on opposite sides of bearing hole 9. Two permanent magnets 44 are disposed between the two portions 43 of armature 5 on opposite sides of bearing hole 9 to extend between said plastic formations 19 and 20. The ferromagnetic portions 43 extend parallel to one another and their length is selected in such a manner that, when in position in the relay, their end portions straddle the adjacent end portions of the pole shoes 3 of magnet core 2. A polarized relay provided with an armature 5 of the type just described is operable as a bistable switching device because the equally long end portions of ferromagnetic portions 43 overlap effective pole faces 4 of equal size on the pole shoes 3 of magnet core 2. Thus, the attractive forces produced by the permanent magnets 44 inserted in the armature 5 will cause the actuator to remain in the respective last switching position into which it was brought by energization of the relay, it not being necessary to continue the supply of electric energy. The contact springs 12 are operated by lugs 21 with which the plastic formations 19 surrounding parts of the armature are provided. In the arrangement shown, the adjusting springs 13 may also act on armature 5 through bearing surfaces 50 provided on the armature. As shown in FIG 1, it is possible to substitute for the above-described armature 5 a modified armature 5 which is again provided with plastic formations 19 and 20 and which includes ferromagnetic portions 45 of equal length extending parallel to one another on opposite sides of the armature bearing hole 9 but longitudinally offset in relation to one another in such a manner that, depending on the switching position of the armature differently sized portions of the pole faces 4 of pole shoes 3 will come into effect. The armature 5′, in similarity to the armature 5, is also provided with permanent magnets which are inserted in such a manner that the bar-like portions are in contact with magnet poles of identical polarity. A relay provided with an armature 5′ of the type just described will be operable as a monostable switching device because, depending on the switching position assumed by the actuator, differently sized effective portions of the pole faces are brought into action. In this case, the stable switching position of the actuator will be determined by the larger of the two pole faces 4 which comes into action. It has already been proposed to store the force produced by the permanent magnets in the contact springs by exerting a force on the contact springs. In such an arrangement, the contacts will have to be opened by the inherent force of the contact springs. However, in cases in which the relay was energized by an excessively strong current in order to close the respective contacts, the contacts may adhere to one another as a result of a slight welding action so that the spring force will no longer be sufficient to open the contacts. In the embodiments of the invention just described, this risk is avoided almost completely in view of the fact that the contacts are reopened against the bias of the contact springs by the entire force produced by the system of magnets.

FIGS. 2, 3 and 4 illustrate relays of the general type shown in FIG. 1. In such relays, the pre-assembled contact carriers 7 have been inserted into the bobbin 1, and the armature bearing plate 25 and the armature 5 have been placed in position. As will be seen in FIG. 3, the base of pivot pin 22 is surrounded by an annular bead 52 serving to establish a predetermined air gap 53 between bearing plate 25 and armature 5. The relay is enclosed in a housing can 23 which is closed at its bottom by a base plate 40. As will be seen in FIGS. 2 and 4, housing can 23 is formed with internal rib-like projections 41 which extend between the upper lugs 11 of contact terminals 8 projecting from contact carriers 7 and which bear against said contact carriers 7 and armature bearing plate 25 which latter members act as fixed abutments. This arrangement serves to increase the rigidity of housing can 23 and to maintain the play of the bearing supporting the armature 5 even in cases in which the entire relay is subjected to large mechanical loads; in addition, this arrangement tends to increase the dielectric strength between the lugs 11 of contact terminals 8 which are separated by said rib-like projections of the housing can.

Figure 23:
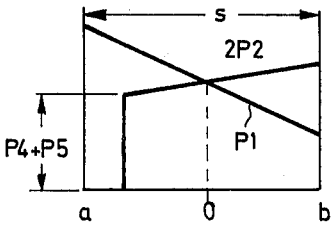
Figure 24:
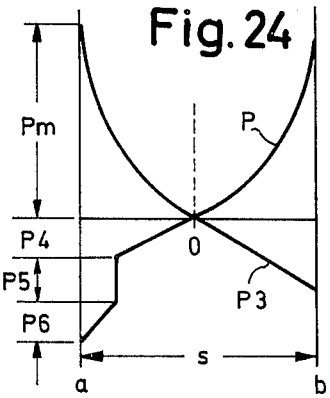

The relays shown in FIGS. 2 to 4 are constructed as polarized bistable relays which are provided with an H-shaped armature 5 of the type shown in FIG. 1. More in particular, the relay of FIG. 2 includes four normally open contacts. In view of this fact, there have been substituted for two of the afore-described lugs 21 two diametrically opposed bearing surfaces 51 on the ends of armature 5, such bearing surfaces being adapted to cooperate with actuating members 14. Each actuating member 14 is attached to the free end of an associated adjusting spring 13 and is arranged to extend through an aperture formed in the associated contact spring 12. With the relay of FIG. 2 in the position shown, all of the four contacts are open. Those contacts with which the corresponding actuating member 14 extends through the aperture 15 of the associated contact spring 12 are held in their open positions because the force of the adjusting spring 13 exceeds the force of contact spring 12. The remaining contact springs 12 have been operated by the lugs 21 of armature 5 which have lifted the contact springs from the portions 10 serving as fixed contacts. FIGS. 23 and 24 illustrate for the case of the relay of FIG. 2 the pattern of the forces occurring in the relay as a function of armature travel *s*. Said armature travel *s* is plotted on the abscissa, the forces being plotted in the ordinate direction. The switching position shown in FIG. 2 corresponds to point *b* in FIGS. 23 and 24. The contact spring forces acting on armature 5 are indicated as 2P2, the adjusting spring force opposing such forces being indicated as P1. With armature 5 assuming its centered position O as shown in FIGS. 23 and 24, the forces P1 and 2P2 are of equal magnitude and will cancel one another. The differential force exerted by the springs is designated as P3 and plotted in the lower part of FIG. 24. As armature 5 moves further towards its position *a*, the preloaded contact springs 12 will abut the portions 10 of contact terminals 8 serving as fixed contacts, the respective contact forces acting on such contacts being indicated in FIG. 24 as P4 and P5. In any case, the forces applied by contact springs 12 on armature 5 will be removed at the moment at which the contacts are closed. After the contacts are closed, the armature 5 which, according to FIG. 24, is operated by the permament magnet force P which increases approximately quadratically as a function of its deflection will exclusively have to overcome the force P1 exerted by the adjustable springs. That portion P6 of the adjusting spring force P1 which with the armature in its switching position *a* exceeds the sum of the contact forces P4 and P5 will be derived from the permanent magnet force and stored in adjusting spring 13. Therefore, when the relay is to be re-energized, it will be necessary to supply only that amount of electric energy which is sufficient to supply the difference between the permament magnet force Pm and the sum of the stored spring forces P4 + P5 + P6.

Figure 21:
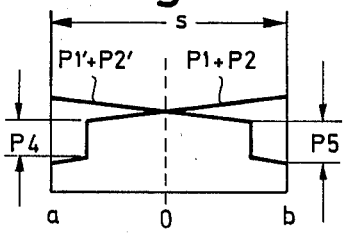
Figure 22:
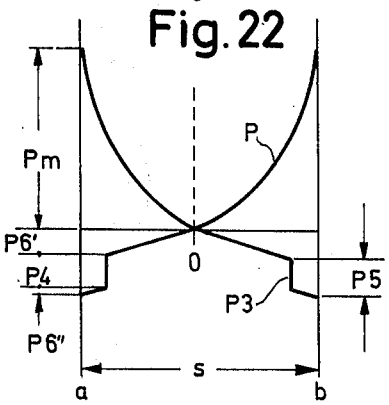

The relay shown in FIG. 4 comprises two normally open contacts and two normally closed contacts. The contact springs 12 are operated by lugs 21 of the plastic formations 19 on armature 5, whereas the adjusting springs 13 are operated by bearing surfaces 50 formed on said lugs. The pattern of the forces occurring in the relay of FIG. 4 as a function of armature travel *s* is shown in FIGS. 21 and 22. The switching position shown in FIG. 4 corresponds to point *b* in FIGS. 21 and 22. The forces exerted on armature 5 from one side thereof by adjusting spring 13 and contact spring 12 act in the same direction. However, the adjusting spring forces P1 and P1′ as well as the contact spring forces P2 and P2′ applied to the armature from opposite sides thereof act in opposite directions. The various spring forces acting on armature 5 produce a resultant force P3 which becomes zero with the armature assuming its centered position. With armature 5 in its centered position, the magnetic force P opposing said resultant spring force will also be zero but will increase approximately quadratically beyond this centered position. In FIGS. 21 and 22 the contact forces capable of being produced by the preloading of contact springs 12 are shown at P4 and P5.

With armature 5 assuming one of its terminal positions *a* and *b* , the armature will still be acted upon by forces P6′ and P6″ which are respectively applied by two oppositely arranged adjusting springs 13. The forces P6′ and P6″ of said adjusting springs 13 and the force P4 of one of contact springs 12 oppose the magnet force Pm so that for the purpose of energizing the relay it will be necessary to supply such an amount of electric energy only as will be required to produce a corresponding differential force. It will, therefore, be seen that also the relay of FIG. 4 is characterized by a particularly small energy requirement which, however, cannot be reduced indefinitely because such factors as external influences such as shocks or vibrations, and unavoidable manufacturing tolerances have to be taken into consideration.

FIGS. 5 to 16 illustrate embodiments of relays according to the invention in which the bobbin 1 in which the magnet core 2 is received is provided with an injection-molded jacket of thermoplastic material carrying an integrally formed pivot pin designed to support the pivotally mounted armature 5. As particularly shown in FIGS. 8 and 14, armature 5 is provided intermediate its ends with a blind hole 29 in which pivot pin 22 is received. The operation of forming said blind hole 29 presents no manufacturing problems in view of the fact that this hole is formed in the plastic formation 20 surrounding a central portion of the armature. The free end of pivot pin 22 forms a part-spherical surface 30, this surface bearing against the bottom 31 of the blind hole. The depth of blind hole 29 is selected to be smaller than the free length of pivot pin 22 so that a small air gap 53 remains between the injection-molded enclosure 54 of plastic material and the plastic formation 20 with which armature 5 is provided. Thus armature 5 is supported for rotation in such a manner that the frictional forces opposing rotation of the armature are kept at a minimum. In order to prevent armature 5 from being disengaged from pivot pin 22, said armature is provided on its upper surface 32 with a conical projection 33 whose height is selected in such a manner that, with housing can 23 in position, there will remain a narrow air gap 34 between such projection 33 and the adjacent inner surface of housing can 23. The width of air gap 34 is determined by the magnitude of unavoidable tolerances regarding the flatness of the upper wall of housing can 23. Since air gap 34 is extremely narrow, the relay may be installed in any desired orientation. As shown in FIGS. 5, 6, 7 and 9, housing can 23 is provided with internal rib-like projections 41 serving to enhance the rigidity of the housing can and adapted to bear against stationary abutment 42 provided, for example, on the plastic enclosure 54 of coil 48. With this arrangement, the freedom of armature 5 will be maintained even in cases in which the relay is subjected to mechanical loads, for example by pressure being exerted on housing can 23. During the operation of injection-molding the enclosure 54 surrounding bobbin 1, there will simultaneously be molded a baseplate-like bottom portion 37 as shown in FIGS. 10 and 11 between the recesses 6 for receiving the contact carriers 7 indicated by cross-hatching FIG. 11 and, in addition, a cavity 56 adapted to receive electrical circuit elements, said baseplate-like bottom portion 37 being provided with apertures 38 (FIG. 11) adapted to receive the contact terminals 8 extending therethrough. As shown on an increased scale in FIGS. 12 and 13, said apertures 38 formed in said baseplate-like bottom portion 37 are surrounded on the side thereof facing the interior of the relay with ridge-like projections 39 having a triangular cross-sectional shape. Such projections 39 are adapted to being used in welding together said baseplate-like bottom portion 37 and said contact carriers 7 with the aid of an ultrasonic welding process or the above-described hot-plate welding process. As shown in FIG. 15, such welding operation will cause the material of said ridge-like projections 39 to be softened, thus hermetically sealing towards the exterior of the relay the contact terminal 8 which is embedded in contact carrier 7 and which extends with a predetermined clearance through its associated aperture 38. The height of each projection 39 is selected in such a manner that there will remain a narrow air gap 55 after contact carrier 7 has been welded to said baseplate-like bottom portion 37. In the arrangement shown, air gap 55 serves to compensate for unavoidable manufacturing tolerances to be expected in contact carrier 7 and/or bottom portion 37.

The relays shown in FIGS. 5 to 8 comprise adjusting springs 13 which are provided at each of their free ends with two slots 16 extending longitudinally of such springs. In this arrangement, the forces produced by the end portions 17, 17′ of the adjusting springs separated by said slots 16 are respectively transmitted to contact spring 12 and the plastic formation 19′. FIG. 16 is an enlarged fragmentary view of such a slotted end of an adjusting spring 13. The end portions 17′ exert forces on the adjacent contact spring 12, thus increasing the contact force during contact closure, whereas the central end portion 17 of adjusting spring 13 bears against armature 5, thus increasing the amount of permanent magnet force capable of being stored. The forces coming into play during a switching operation in the relays shown in FIGS. 5 and 7, respectively, will be explained in more detail in the following paragraph.

Figure 17:
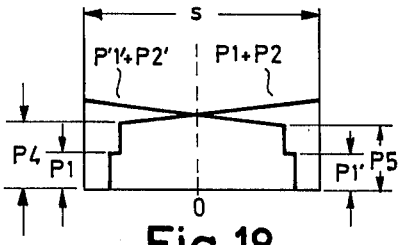
Figure 18:
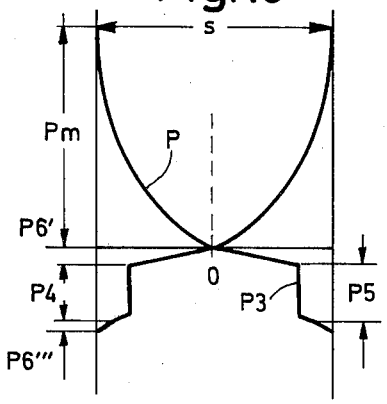

The relay of FIG. 5 is provided with two normally closed contacts and two normally open contacts; in FIG. 5 the armature 5 of the relay is shown in its centered position. The pattern of the spring forces and of the attractive force exerted by the permanent magnets is shown in FIGS. 17 and 18. The forces exerted on one side of armature 5, i.e., the force P2 applied by contact springs 12 and the force P1 applied by adjusting spring 13, act in the same direction but in opposition to the forces which are applied to the opposite side of armature 5 by the respective contact and adjusting springs, such forces being respectively designated P2′ and P1′. The resultant P3 of all spring forces acting on armature 5 is shown in FIG. 18. With the armature assuming its centered position corresponding to point O, the resultant force is zero. As compared to the contact forces occurring in the relay of FIG. 4, the contact forces P4 and P5 capable of being obtained in the relay of FIG. 5 are respectively increased by the force P1 or P1′ exerted by the respective adjusting spring 13. Due to the fact that upon a contact being closed the end portions 17′ of adjusting spring 13 are brought into contact with contact spring 12 results in an increase in the current carrying capacity of the respective contact. This effect is to be attributed on the one hand to an increase in contact force resulting in a reduction in contact resistance and on the other hand to the fact that the adjusting spring will itself act as a current carrying member.

Figure 19:
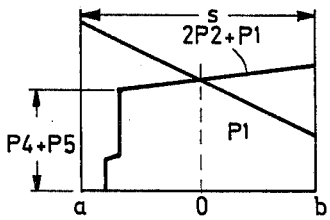
Figure 20:
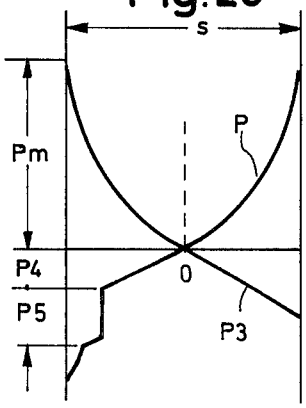

The relay shown in FIG. 7 resembles the relay shown in FIG. 2 in that it is also provided with four normally open contacts. The pattern of the forces occurring in this relay, such forces being a function of actuator deflection $s$, is shown in FIGS. 19 and 20. With all contacts being fully opened, the position of the relay corresponds to point $b$ in FIG. 19; when one half only of the contacts of the relay is considered, two contact springs 12 apply a force 2P2 on armature 5, and one adjusting spring 13 applies thereto a force P1. These forces 2P2 + P1 are opposed by the force P1 applied by the upper adjusting spring 13 shown in FIG. 7. The resulting force P3 is shown in FIG. 20 to become zero as armature 5 approximately assumes its centered position. This resulting force opposes the quadratically varying force P produced by the permanent magnets. Also in this case, the fact that the two end portions 17′ of adjusting spring 13 come into action results in an increase in contact force, this, however, applying only to the lower normally open contact of that half of the relay of FIG. 7 which is here being considered. Thus, the contact force P5 as compared to the contact force available in the relay of FIG. 2 is increased by the force exerted by the adjusting spring, whereas the contact force P4 occurring at the other contact will assume the same value as in the case of the relay of FIG. 2.

The embodiment shown in FIGS. 25 and 26 differs from that of FIG. 1 in the way the contact carriers 7 and contact springs 12 are formed while the remaining elements, particularly armature 5, bearing plate 25, base plate 40 and housing can 23 are identical. In the embodiment of FIGS. 25 and 26, three contact terminals 8 are embedded in the contact carrier 7′, the outer two of the contact terminals 8 being connected with the portions 10 forming the fixed contacts, while the middle contact terminal 8 is connected to a common lug 11′ carrying a common contact spring 12′. The middle lug 11′ is divided by two cuts 11*e* and 11*f* into three upwardly extending smaller lugs 11*a*, 11*b* and 11*d* with the lug 11*d* being substantially disposed in the plane of the portions 10. The lug 11*d* carries on its surface opposite from the coil bobbin 1 a projection 11*c* onto which contact spring 12′ may be mounted with a corresponding central hole 12*c*. The contact spring 12′ is provided with a movable contact 12*a*, 12*b* at each end. When assembled, the movable contacts 12*a*, 12*b* are opposite to the portions 10. Between the movable contacts 12*a*, 12*b* and the middle hole 12*c*, the contact spring 12′ is furthermore provided with two tongues 12*d* und 12*e* which are cut out along three sides and are bent to the side opposite to that of the movable contacts. As shown in FIG. 26, the free ends of the tongues 12*d*, 12*e* in the assembled condition abut the inner surfaces of the lugs 11*a* and 11*b*, respectively, thereby increasing the force of the contact spring. By correspondingly setting the tongues 12*d*, 12*e*, the contact pressure may be finely adjusted.

The embodiment shown in FIG. 27 differs from that of FIG. 1 in the shape of the coil bobbin and the contact carrier. While in FIG. 1 the coil bobbin 1 constitutes the basic element and one contact carrier is inserted into corresponding recesses 6 provided on each side of the coil bobbin, the two contact carriers in the embodiment of FIG. 27 are in the form of an integral frame 57 into which the coil bobbin 1′ is inserted. In this case the frame 57 thus forms the supporting element of the entire relay. The frame 57 has a closed lower side penetrated by the contact terminals 8. In the embodiment of FIG. 27 as in that of FIG. 1, the magnet core is disposed within the coil body 1′ with its two pole shoes 3′ extending upwardly out of the coil bobbin. However, the pole shoes 3′ are provided with outwardly stepped portions 59 extending beyond the coil bobbin 1′ in the longitudinal direction. When assembled, the stepped portions 59 engage correspondingly shaped central recesses 58 provided at the inner side of the end walls of frame 57. In this way the coil bobbin in positioned accurately within the frame. Lateral connecting portions 60 are also provided on the end walls of frame 57 and are connected to coil terminals 49 extending downwardly from the frame 57. When inserting the coil bobbin 1′ into the frame 57, the terminals 61 forming the ends of coil 48 engage the connecting portions 60 and are soldered or welded thereto.

FIG. 28 shows the contact carriers 7″ which form the two main parts of frame 57. The contact carriers 7″ into which the contact terminals 8 and coil terminals 49 are embedded consist of thermosetting plastic and are encased by injection molded thermoplast to form the frame 57 shown in FIG. 27 in its complete form. The molded encasing forms an upper edge 62 which in the assembled condition of the relay engages the lower edge of the housing can 23. As a final step in the assembly of the relay, the housing can 23 is welded to the thermoplast encasing of the frame 57. The entire relay is thus provided with hermetically tight encasing only penetrated at its lower side by the terminals.

In the embodiment represented in FIGS. 29 to 31, similarly as in FIGS. 27 and 28, two contact carriers 7′ form an integral frame into which the coil bobbin 1′ including the magnet core 2 is inserted. As particularly understood from FIG. 29, the coil bobbin 1′ consists of two flat parts of general I-shape disposed on both sides of the magnet core 2 and retained together with the core by the coil 48 to form a unitary structural element. The two contact carriers 7′ are directly supported by the two ends of the magnetic core extending from the coil bobbin 1′ and are welded together at their surfaces facing each other below the coil 48 and outside the magnet core 2. A welding seam is shown at 70 in FIG. 29. To facilitate the assembly and positioning of the two bobbin parts, one of them has a stud 71 engaging a corresponding hole in the other part. The armature 5′ is similarly as in the embodiments of FIGS. 5 to 8 partially embedded in plastic formations 19′ and 20′ with the middle formation 20′ having its center two coaxial bearing pins 63 extending upwardly and downwardly. The bearing pins 63 engage corresponding bearing sleeves 64 integrally formed on a lower bearing plate 65 and an upper bearing plate 66. The two bearing plates 65 and 66 are interconnected by straps 67 so as to form a cage pivotly mounting in its interior the armature 5′. The bearing plates 65 and 66 are provided at their outermost ends with cut-outs embracing the pole shoes 3 of the magnet core 2. The armature 5′ is thus positioned in fixed spatial relationship to the magnet core 2.

For increasing the breakdown voltage between the various contacts, the housing can is provided similarly as in the embodiment of FIGS. 5 to 8 with inner rib-like projections 41. Furthermore, the housing can 23 is formed of transparent plastics material; as shown in FIG. 30, it has integral lense portions 68 formed above the contact places and providing a magnifying effect to facilitate the observation of the contact operation. A further difference of the embodiment of FIGS. 29 to 31 with respect to those described above resides in the fact that the contact carriers are provided with stepped portions 69 shown in FIGS. 29 and 30 from which the coil terminals 49 project. These stepped portions 69 provide a greater distance and thus a higher breakdown voltage between the coil terminals and the switching contacts 10 which are at a different potential.

What is claimed is:

1. An electromagnetic relay comprising within its coil bobbin a magnet core, the ends of which extend substantially at right angles to the longitudinal axis of the bobbin so as to form pole shoes projecting from said coil bobbin and having mutually aligned pole faces and further comprising an armature which is disposed externally of said bobbin between said pole shoes of said magnet core and which is pivotally mounted for rotation about one of its centroid axes, said one axis extending perpendicularly to the longitudinal axis of said bobbin, wherein contact terminals disposed on both sides of the longitudinal axis of said coil bobbin are positively located by being embedded in a contact carrier means, said coil bobbin and the contact carrier means extending substantially over the entire length of the coil bobbin being provided with engaging means for the mutual positioning and retaining of said contact carrier means and said coil bobbin, said contact terminals having associated therewith prelocated contact springs arranged within said relay, the forces exerted by said contact springs interacting through said armature, and bearing means for said armature provided substantially centrally of said coil bobbin between said pole shoes.

2. The relay of claim 1, wherein the contact carrier means include a pair of parallel contact carriers, each of which is provided with guides at its ends for engaging recesses disposed on each end of said coil bobbin on both sides thereof.

3. The relay of claim 1, wherein said contact terminals embedded in said contact carrier means are equally spaced apart and extend parallel to said pole shoes.

4. The relay of claim 1, wherein lugs formed by parts of said contact terminals projecting from said contact carriers on the side thereof which is adjacent to said pole shoes are disposed in lines extending parallel to an imaginary line interconnecting said pole shoes.

5. The relay of claim 1, wherein said contact terminals embedded in said contact carrier means and extending out of said relay are arranged in a predetermined pattern.

6. The relay of claim 1, wherein said contact springs are attached to the lugs of certain contact terminals extending from central portions of said contact carrier means on that side thereof which is adjacent to said pole shoes.

7. The relay of claim 6, wherein said contact springs comprise adjusting and contact springs, said contact springs including apertures, each adjusting spring carrying at its free end an actuating member extending through an aperture in a contact spring associated therewith.

8. The relay of claim 6, wherein said contact springs comprise adjusting and contact springs, each adjusting spring being adapted to act upon the contact spring associated therewith, and the adjusting force is adapted, after a contact-making operation is completed, to be added to the contact force exerted by said associated contact spring so as to increase the contact force.

9. The relay of claim 8, wherein each adjusting spring is provided at its free end with at least one slot extending in the direction of the major dimension of said adjusting spring and forming end portions, the forces exerted by the end portions separated by said slot being correspondingly transmitted to said armature and one contact spring, respectively.

10. The relay of claim 1, wherein said contact carrier means are made of a thermoplastic material and are of substantially parallelepiped shape having a width which is small as compared to the length thereof, said contact carrier means being provided with lateral guide portions fitted into correspondingly dimensioned recesses formed in said coil bobbin, said contact terminals being formed as inserts embedded in said contact carrier means which carrier means are formed as injection moldings, and said contact terminals and said contact springs each forming a contact unit.

11. The relay of claim 1, wherein said contact carrier means comprise identical insulating bodies.

12. The relay of claim 1, wherein said armature is at least partially embedded in plastic material formations, and said contact springs are arranged to be operated by lugs with which plastic formations are provided.

13. The relay of claim 1, wherein said contact springs include preloaded contact springs and adjusting springs which are arranged to apply forces acting in opposite directions to opposite sides of said armature.

14. The relay of claim 13, wherein with said armature assuming its centered position, in which position the lingitudinal axis of said armature coincides with an imaginary line interconnecting with said pole shoes, the forces applied to said armature by said preloaded contact and adjusting springs are adapted to cancel each other.

15. The relay of claim 1, wherein a bearing means made of a plastic material is formed on said armature intermediate its ends.

16. The relay of claim 15, wherein said armature is supported for rotation by a pivot pin, the length of said pivot pin exceeding the length of a bearing hole extending through said armature by an amount defining a predetermined end play of said bearing means, and, a housing can enclosing said relay, the end face of said pivot pin bearing against an adjacent inner surface of a wall of said housing can.

17. The relay of claim 16, wherein said pivot pin is integrally formed with a central portion of a substantially rectangular bearing plate, the length of said bearing plate being selected such that its end faces are fixedly located by said pole shoes.

18. The relay of claim 17, wherein said bearing plate is provided intermediately of its end faces which are adjacent to said pole shoes with recesses shaped to match the profile of said pole shoes.

19. The relay of claim 17 wherein said contact carrier means are provided with stepped recesses for engagement with said bearing plate inserted between said pole shoes.

20. The relay of claim 1, wherein said armature is centrally provided with a blind hole, and is supported for rotation on a pivot pin by means of said blind hole, the free end of said pivot pin being provided with a radius, said free end of said pivot pin bearing against the bottom of said blind hole, and the depth of said blind hole being smaller than the free length of said pivot pin.

21. The relay of claim 20, wherein said armature is provided on its upper surface and in alignment with its axis of rotation with a convex or conical projection, the height of said projection being selected such that, with a housing can in position on said relay, there remains a narrow air gap between the inner surface of an adjacent wall of said housing can and said projection.

22. The relay of claim 1, wherein said coil bobbin is provided with said magnet core and a coil, said coil being provided with an injection-molded jacket made of a thermoplastic material, and including a pivot pin for supporting said armature for rotation, said pivot pin being integrally formed with said jacket.

23. The relay of claim 22, wherein a baseplate-like bottom portion is integrally formed with said jacket, said baseplate-like portion being provided with apertures through which said contact terminals extend out of the relay.

24. The relay of claim 23, wherein said apertures formed in said baseplate-like bottom portion are surrounded on the side of said bottom portion facing the interior of the relay by ridge-like projections having a prismatic or triangular cross-section.

25. The relay of claim 24, wherein said baseplate-like bottom portion of the relay is welded together with said contact carrier means.

26. The relay of claim 20, including a housing can, said housing can being provided with internal rib-like projections for supporting said housing can by bearing against stationary abutments provided in the interior of the relay in such a manner as to ensure the maintenance of a predetermined end play in a vertical direction in the bearing means supporting said armature for rotation.

27. The relay of claim 23, including a housing can, said housing can being made of a thermoplastic material and being connected by welding to said baseplate-like bottom portion or to said base plate of said relay, which bottom portion is also made of a thermoplastic material.

28. The relay of claim 1, wherein said armature is partially surrounded by plastic formations and is provided on opposite sides of the axis on which it is supported for rotation with elongated ferromagnetic portions, said ferromagnetic portions being interconnected by at least one permanent magnet, said portions being parallel to one another and of equal length and straddle the pole shoes of said magnet core.

29. The relay of claim 1, wherein said armature is provided with two bar-like ferromagnetic portions of equal length, said ferro-magnetic portions being arranged parallel to one another on opposite sides of the bearing means of said armature, said ferromagnetic portions being longitudinally offset in relation to one another in such a manner that, depending on the switching position assumed by said armature, differently sized effective pole faces of said pole shoes of said magnet core are brought into action.

30. The relay of claim 28 wherein said relay comprises two permanent magnets disposed on opposite sides of the pivotal axis of said armature and between said ferromagnetic portions.

31. The relay of claim 1, wherein said coil bobbin is of single-piece construction and is provided with a groove adapted to receive a substantially U-shaped magnet core.

32. The relay of claim 31, wherein said magnet core inserted in said coil bobbin is covered by a small plate of insulating material.

33. The relay of claim 1, wherein said magnet core is embedded by injection molding as an insert in said coil bobbin.

34. The relay of claim 1, whrerein said coil bobbin includes two identical component parts each provided with a recess for receiving said magnet core.

35. The relay of claim 34, wherein the two component parts of said coil bobbin are provided with matching nose-like projections and recesses for interengagement so as to hold said component parts together.

36. The relay of claim 1, wherein a contact spring extends substantially parallel to the longitudinal coil axis on each side of said axis, each contact spring being centrally mounted on its respective contact carrier means and being provided on each of its free ends with a movable contact, and, each free end of each contact spring being actuable by a lug of the armature.

37. The relay of claim 36, wherein each contact spring is provided with a pair of tongues cut out of the contact spring on three sides, bent out of the plane of the contact spring and disposed between said movable contacts and a central mounting, the free ends of said tongues extending towards each other and bearing against a central mounting element of the contact carrier means.

38. The relay of claim 37, including a mounting element on each contact carrier means for its respective contact spring, the mounting element and the central mounting elements for the bent tongues being connected to a common contact terminal.

39. The relay of claim 1, wherein the contact carrier means comprise a frame.

40. The relay of claim 39, wherein the frame is closed at the side of the contact terminals.

41. The relay of claim 39, wherein the frame includes recesses engaged by the coil bobbin through projections provided at the pole shoes of the magnet core.

42. The relay of claim 39, including coil terminals disposed at the coil bobbin in such a way that, in inserting the coil bobbin into the contact carrier frame and connecting portions disposed on said frame, said coil terminals being arranged to engage said connecting portions.

43. The relay of claim 1, wherein the contact carrier means is embedded in a frame-like plastic casing.

44. The relay of claim 43, including a housing can and wherein the contact carrier means into which the contact terminals are embedded consists of thermosetting material and is provided with an encasing of thermoplastic material, the encasing and the housing can cooperating to form a housing adapted to be closed by welding in an hermetically tight manner.

45. The relay of claim 1, wherein the contact carrier means are supported directly on the two ends of the coil bobbin and are welded together at their mutually contacting surfaces.

46. The relay of claim 45, wherein the armature is a permanent magnetic material partially embedded in plastic formations and is positioned at the pole shoes of the magnetic cre by a pair of identical bearing members consisting of plastic material.

47. The relay of claim 1, including a housing can provided wih rib-like projections projecting inwardly of the can and disposed between the respectively adjacent contact springs.

48. The relay of claim 1, including a housing can made of transparent plastic material and having at least one integrally formed lens for viewing a contact location disposed therebelow.

49. The relay of claim 1, wherein the contact carrier means is provided with a stepped portion at each coil terminal.

50. The relay of claim 1, including adjusting springs and wherein said armature is at least partially embedded in plastic material formations, said adjusting springs being arranged to be operated by bearing surfaces provided on said plastic formations.

51. The relay of claim 1, including adjusting springs which are arranged to apply forces acting in opposite directions to opposite sides of said armature.

52. The relay of claim 24, including a base plate welded together with said contact carrier means.

* * * * *

UNITED STATES PATENT AND TRADEMARK OFFICE

CERTIFICATE OF CORRECTION

PATENT NO. : 3,993,971

DATED : November 23, 1976

INVENTOR(S) : KENJI ONO ET AL

It is certified that error appears in the above-identified patent and that said Letters Patent are hereby corrected as shown below:

Column 4, line 27, change "5" (second occurrence) to --5'--;

Column 5, line 62, change "adjustable" to --adjusting--;

Column 7, line 21, after "cross-hatching" insert --in--;

Column 9, line 42, after "the" (first occurrence) insert --two--;

line 56, change "7'" to --7'''--;

line 62, change "7'" to --7'''--;

Column 10, line 5, after "having" insert --in--;

Claim 1, line 7, after "said" (first occurrence) insert --coil--;

Claim 14, line 3, change "lingitudinal" to --longitudinal--;

Claim 46, line 4, change "cre" to --core--;

Claim 47, line 2, change "wih" to --with--.

Signed and Sealed this

Third Day of May 1977

[SEAL]

*Attest:*

RUTH C. MASON
*Attesting Officer*

C. MARSHALL DANN
*Commissioner of Patents and Trademarks*